US011292034B2

(12) United States Patent
Crowell et al.

(10) Patent No.: US 11,292,034 B2
(45) Date of Patent: Apr. 5, 2022

(54) HAND HELD ROTARY CLEANING TOOL WITH SPLASH GUARD

(71) Applicant: Robert Bosch GmbH, Stuttgart (DE)

(72) Inventors: Christopher Crowell, Chicago, IL (US); Jeremy Rubens, Palatine, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 381 days.

(21) Appl. No.: 16/443,376

(22) Filed: Jun. 17, 2019

(65) Prior Publication Data

US 2020/0391252 A1 Dec. 17, 2020

(51) Int. Cl.
*B08B 1/04* (2006.01)

(52) U.S. Cl.
CPC ..... *B08B 1/04* (2013.01); *B08B 2203/0264* (2013.01)

(58) Field of Classification Search
CPC .... B08B 1/04; B08B 2203/0264; A47L 11/40
See application file for complete search history.

(56) References Cited

U.S. PATENT DOCUMENTS

| | | | | |
|---|---|---|---|---|
| 2,981,966 | A | 3/1959 | Beffel | |
| 2,986,756 | A | 6/1961 | Descarries | |
| 3,987,512 | A | 10/1976 | Meyerhoefer | |
| 5,280,663 | A | 1/1994 | Proulx | |
| 5,353,461 | A * | 10/1994 | Enriquez | A46B 13/02 15/104.095 |
| 5,513,413 | A | 5/1996 | Myers et al. | |
| 5,706,549 | A | 1/1998 | Legatt et al. | |
| 5,950,268 | A | 9/1999 | Murphy et al. | |
| 7,025,835 | B2 | 4/2006 | Pedlar et al. | |
| 7,540,056 | B2 | 6/2009 | Dotterman et al. | |
| 8,141,197 | B2 | 3/2012 | Allard | |
| 8,567,457 | B2 | 10/2013 | Polewarczyk et al. | |
| 10,980,388 | B2 * | 4/2021 | Crowell | A47L 11/4083 |
| 2019/0085503 | A1 | 3/2019 | Tsui | |
| 2020/0390311 | A1 * | 12/2020 | Crowell | A47L 11/4038 |

FOREIGN PATENT DOCUMENTS

| | | |
|---|---|---|
| DE | 19819640 | 11/1999 |

OTHER PUBLICATIONS

Image—Makita Tool.

* cited by examiner

*Primary Examiner* — Michael D Jennings
(74) *Attorney, Agent, or Firm* — Kelly McGlashen; Maginot, Moore & Beck LLP

(57) ABSTRACT

A hand-held rotary cleaning tool includes a housing that encloses an electric motor and a gear set that connects the motor to an output shaft. The rotary cleaning tool includes at least one cleaning accessory that is detachably connected to the output shaft, and a flexible splash guard. The splash guard surrounds the output shaft and cleaning accessory so as to prevent liquid splash during tool use. The splash guard includes a reinforcing ring that is formed of a material that is less flexible than the material used to form the splash guard body. The reinforcing ring prevents the splash guard from excessive deformation, whereby interference of the splash guard with the cleaning accessory or the output shaft is minimized or avoided. The reinforcing ring may also include other features which enhance the cleaning function of the rotary cleaning tool.

17 Claims, 8 Drawing Sheets

HAND HELD ROTARY CLEANING TOOL WITH SPLASH GUARD

BACKGROUND

In general, rotary power tools are light-weight, handheld power tools capable of being equipped with a variety of accessory tools and attachments, such as cutting blades, sanding discs, grinding tools, and many others. A rotary cleaning tool is a rotary power tool that facilitates cleaning and includes accessories such as brushes, scrubbing pads and polishing pads, as well as a splash guard that prevents liquid splash during tool use.

Some handheld rotary cleaning tools may include a housing that serves as a handle for the tool and as an enclosure for an electric motor and a battery that supplies power to the electric motor. The electric motor drives an output shaft to rotate at high speeds. The output shaft is equipped with an accessory attachment mechanism that enables a cleaning accessory to be releasably secured to the power tool. In addition, the housing includes a splash guard attachment mechanism that enables the splash guard to be releasably secured to the power tool.

When load is applied to the output shaft, electric current supplied to the motor increases. Some battery-powered rotary cleaning tools are configured to stall the motor in the event of an excessive current in order to protect the motor and battery. If the splashguard is flexible, it may fold in and interfere with the cleaning accessory or the output shaft. Under certain circumstances, such interference can increase load to an extent that stall occurs and/or battery life is decreased. Thus it may be desirable to provide a flexible splashguard that does not induce stall or reduce battery life.

SUMMARY

In some aspects, a hand-held rotary scrubbing tool includes a housing-having a shape that permits holding by a human hand, and a size that permits lifting, manipulation and operation of the tool by the human hand. The tool includes a motor disposed in the housing. The motor includes an output shaft that protrudes out of the housing. The output shaft is configured to be connected to a first accessory in such a way that the first accessory is driven by the motor to rotate relative to the housing about a rotational axis. The tool includes a splash guard that surrounds the output shaft. The splash guard has a proximal end that is connected to the housing, a distal end that is opposed to the proximal end, and a tubular shape of non-uniform diameter. The proximal end has a smaller diameter than the distal end. The splash guard is formed of a first material having a first flexibility. In addition, the splash guard includes a reinforcing ring disposed at the distal end. The reinforcing ring is formed of a second material having a second flexibility, and the second flexibility is less than the first flexibility.

In some embodiments, the reinforcing ring is enclosed within the guard at the distal end of the splash guard.

In some embodiments, the reinforcing ring is joined to the outer surface of the splash guard at the distal end of the splash guard.

In some embodiments, the reinforcing ring is joined to the inner surface of the splash guard at the distal end of the splash guard.

In some embodiments, the reinforcing ring is joined to the inner surface of the splash guard at the distal end of the splash guard, and an output shaft-facing surface of the ring includes ring surface features that are configured to engage, and form a mechanical connection with, corresponding accessory surface features of a second accessory.

In some embodiments, the ring surface features include a helical thread.

In some embodiments, the ring surface features are configured to provide a bayonet connection.

In some embodiments, the reinforcing ring is joined to the inner surface of the splash guard at the distal end of the splash guard, and an output shaft-facing surface of the ring includes ring surface features that direct the flow of fluid within the splash guard.

In some embodiments, the ring surface features include a fin that protrudes from the output shaft-facing surface, and the fin is at an acute angle relative to the output shaft-facing surface.

In some embodiments, the fin is flexible.

In some embodiments, the fin includes several fins, and the fins are spaced apart from each other along a circumference of the shaft-facing surface.

In some embodiments, the surface features are configured to direct fluid within the splash guard toward the output shaft.

In some embodiments, the reinforcing ring is joined to the inner surface of the splash guard at the distal end of the splash guard and the ring has a non-uniform thickness. The thickness of the ring corresponds to a dimension of the ring in a direction perpendicular to the rotational axis.

In some embodiments, the reinforcing ring is joined to the inner surface of the splash guard at the distal end of the splash guard, the ring has an inner surface, and a distance of the ring inner surface from the rotational axis varies along a circumference of the ring.

In some embodiments, the reinforcing ring has an outer diameter that is concentric with the rotational axis and an inner diameter that is eccentric with respect to the rotational axis.

In some embodiments, the splash guard includes at least two annular regions that are spaced apart along a longitudinal axis of the splash guard. The annular regions are more rigid than a foldable intervening region that is disposed between, and is joined to, the two annular regions, whereby the splash guard is collapsible along the longitudinal axis. In addition, the reinforcing ring is supported on one of the annular regions, the one of the annular regions being the annular region that is furthest from the proximal end.

In some embodiments, the first accessory is connected to the output shaft via a connector. The connector includes a hollow stem that is shaped and dimensioned to receive and engage the output shaft, and a base that is disposed at one end of the stem. The base is configured to be detachably mechanically connected to the first accessory.

In some embodiments, the splash guard is flexible and has the shape of a truncated, hollow cone. A proximal end of the splash guard is connected to the tool housing, and the opposed, distal end of the splash guard may contact the surface to be cleaned. The distal end of the splash guard includes a reinforcing ring. The splash guard including the ring is sufficiently rigid to prevent the splash guard from folding into itself and touching the cleaning accessory, and sufficiently flexible to permit the splashguard to flex as it operates, for example to permit cleaning close to walls.

In some embodiments, the ring on the splash guard distal end may serve as both reinforcing feature and a connection interface, allowing other structures to be connected to the splash guard. For example, in some embodiments, a cap be connected to the end of the splash guard by connecting the cap to the connection interface. Advantageously, the cap can be used to seal and store the cleaning accessory (i.e., a polishing pad) after use, whereby the wet tool is enclosed and chips are prevented. In other examples, the connection interface could be used to attach splash guard accessories including, but not limited to, bristles, a sponge edge, a squeegee edge, etc., to the splash guard.

In some embodiments, the ring on the splash guard distal end may serve as both a reinforcing feature and a fluid circulation device. For example, in some embodiments, the ring may include fires that redirect cleaning fluids that collect along the splash guard toward the cleaning accessory. In other embodiments, the ring is free of fins and instead has an eccentric shape. This can be beneficial when the cleaning tool is used to clean a vertical surface and fluid is trapped within the splash guard at the lowest point of the splash guard. By positioning the portion of the splashguard that is closest to the cleaning accessory at the lowest point, fluid trapped at the lowest point is easily taken up the cleaning accessory and redistributed.

BRIEF DESCRIPTION OF THE FIGURES

In FIG. 4, the battery, motor and gear set are shown schematically.

DETAILED DESCRIPTION

Figure 1:
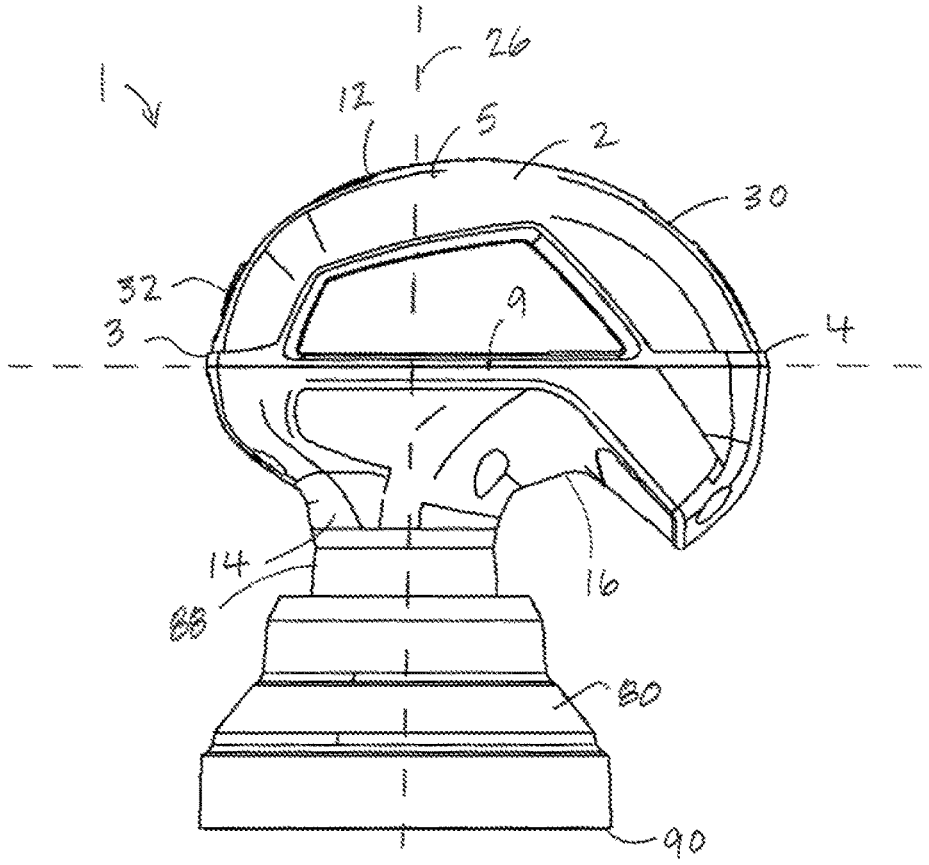
FIG. 1 is a side view of a handheld rotary cleaning 1 including a flexible splash guard having a reinforcing ring.
Figure 2:
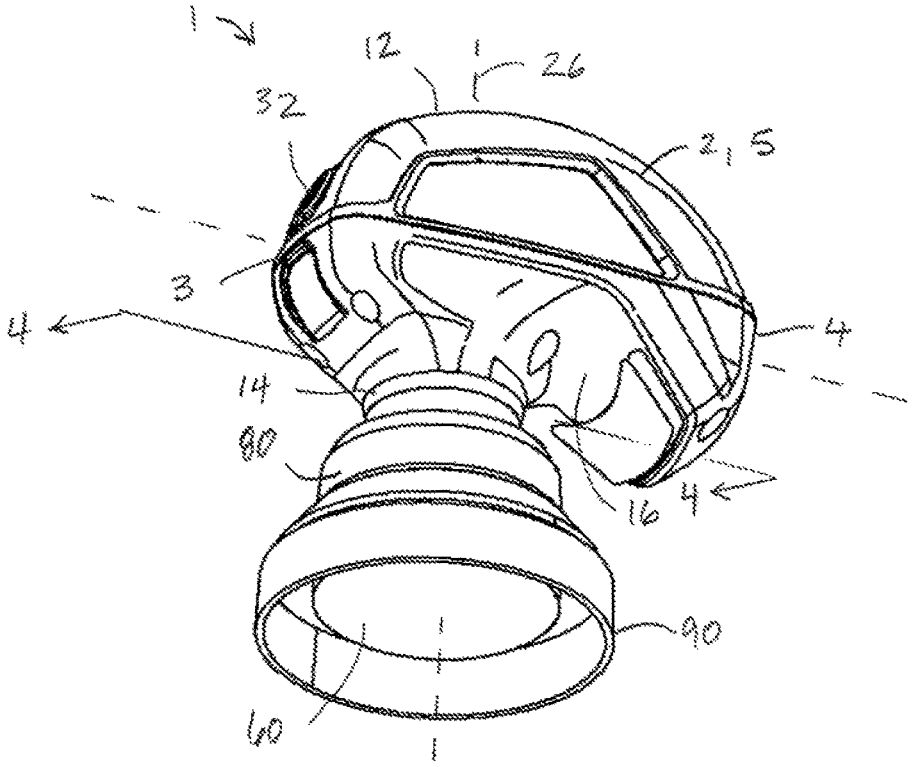
FIG. 2 is a bottom perspective view of the handheld rotary cleaning tool of FIG. 1.
Figure 3:
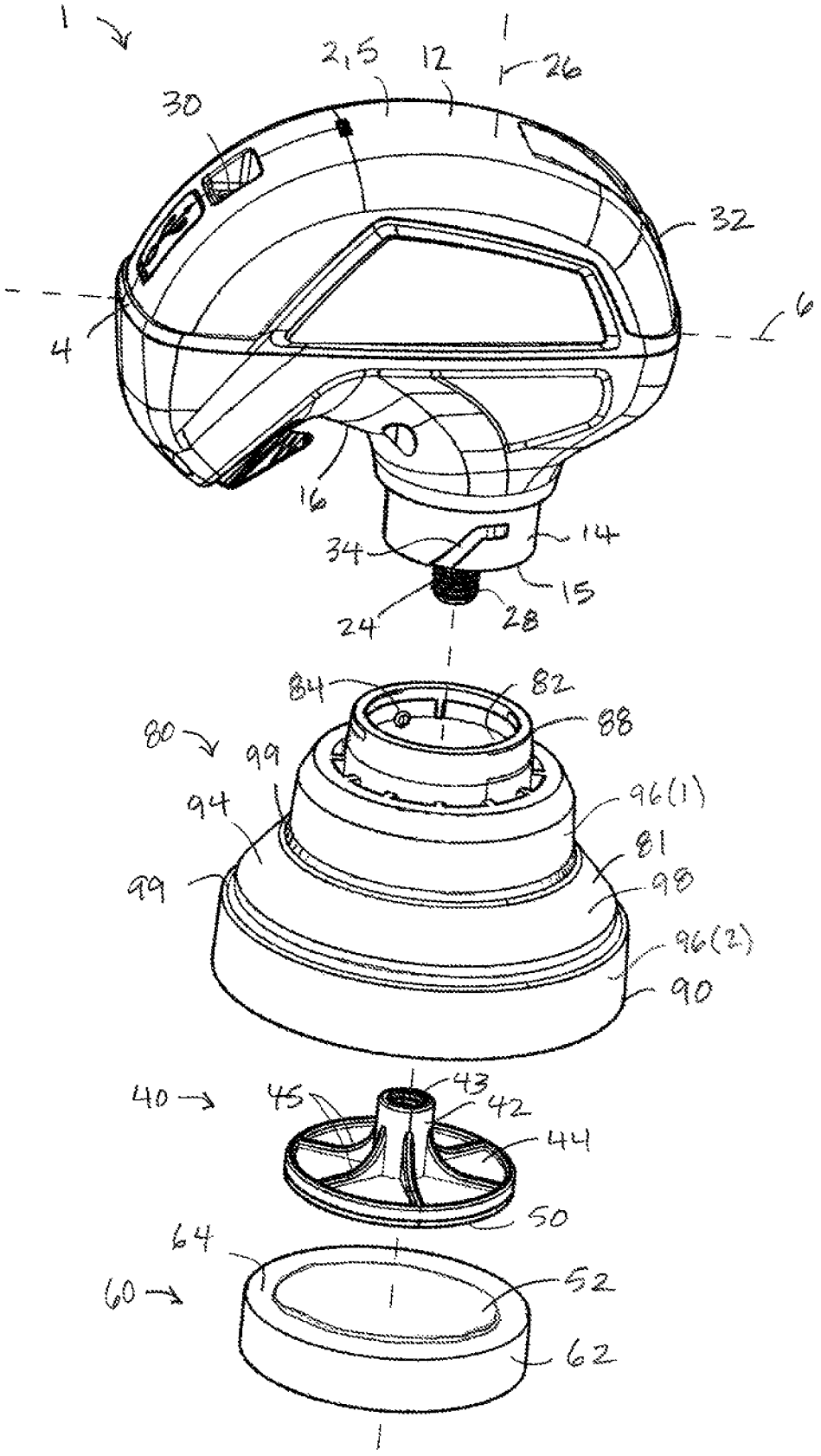
FIG. 3 is exploded view of the handheld rotary cleaning tool of FIG. 1.

Referring now to FIGS. 1-4, a rotary cleaning tool 1 is a hand-held rotary power tool that facilitates cleaning. The rotary cleaning tool 1 includes a housing 2 that encloses an electric motor 20 and a gear set 22 that connects the motor 20 to an output shaft 24 of the tool 1. The rotary cleaning tool 1 includes at least one cleaning accessory 60 that is detachably connected to the output shaft 24, as discussed below. In addition, the rotary cleaning tool includes a flexible splash guard 80 that surrounds the output shaft 24 and the cleaning accessory 60 so as to prevent liquid splash during tool use. The splash guard 80 includes a reinforcing ring 100, described below, that prevents the splash guard from excessive deformation, whereby interference of the splash guard 80 with the cleaning accessory 60 or the output shaft 24 is minimized or avoided. The reinforcing ring 100 may also include other features which enhance the cleaning function of the rotary cleaning tool 1, as discussed in detail below.

The housing 2 serves as a handle 5 of the tool 1, and is shaped and dimensioned to permit the tool 1 to be hand held. As used herein, the term "hand held" refers to a housing having a shape that permits holding by a human hand, and a size and weight that permits the tool 1 to be easily lifted, manipulated and operated by the human hand. In the illustrated embodiment, the housing 2 generally has an ellipsoid shape. The housing 2 is elongated along a major axis 6, and includes a convex portion 12 that faces a palm of a user when the tool 1 is in use. The housing 2 includes a nose portion 14 that surrounds a portion of the output shaft 24 and protrudes in a direction away from the convex portion 12. More particularly, the nose portion 14 protrudes in a direction that is perpendicular to the major axis 6, and is disposed between a midpoint 9 of the major axis 6 and a first end 3 of the housing 2 (e.g., a "front end" of the housing 2). The housing 2 also includes a concavity 16 that is disposed between the midpoint 9 of the major axis 6 and a second end 4 of the housing 2 (e.g., a "rear end" of the housing 2), where the housing second end 4 is opposed to the housing first end 3. The concavity 16 provides a grip that may be grasped by the fingers of a user when the tool 1 is in use.

The housing 2 may be constructed of a rigid material such as plastic, metal, or composite materials such as a fiber reinforced polymer. The housing 2 encloses the electric motor 20 and the gear set 22. The output shaft 24 is driven to rotate about a rotational axis 26 by the motor 20 via the gear set 22, and a portion of the output shaft 24 protrudes from the housing 2. In particular, the protruding portion of the output shaft 24 protrudes from a terminal end 15 of the nose portion 14. The gear set 22 is configured so that the output shaft 24 rotates at a reduced rotational speed relative to the output of the motor 20. The housing 2 also encloses a battery 18 that provides power to the motor 20. In some embodiments, the battery 18 may be recharged via an electrical connector 30 supported on the convex portion 12 adjacent to the housing second end 4. Power to the motor 20 is controlled by a power switch 32 provided on the convex portion 12 adjacent to the housing first end 3.

An outer surface of the nose portion 14 includes features that allow it to mechanically engage with corresponding features of the splash guard 80 and retain the splash guard 80 on the housing 2. For example, in the illustrated embodiment, the outer surface of the nose portion 14 includes a retaining groove 34 disposed on each of opposed sides of the nose portion 14. The retaining grooves 34 open at the terminal end 15 of the nose portion 14, and generally extends along a tortuous path toward the handle 5 and along a circumference of the nose portion 14. The retaining grooves 34 each receive and retain corresponding a bump 84 that protrudes from the splash guard 80, as discussed further below.

The rotational axis 26 of the output shaft 24 is perpendicular to the major axis 6. In addition, the rotational axis 26 intersects the major axis 6 at a location between the center of the major axis 6 and the tool first end 3. The output shaft 24 protrudes from the terminal end 15 of the nose portion 14. The portion of the output shaft 24 that protrudes from the nose portion 14 includes features that allow it to mechanically engage corresponding features of a connector 40. For example, in the illustrated embodiment, the output shaft 24 has an external thread 28 that engages, and forms a mechanical connection with, corresponding internal threads 43 of the connector 40.

The connector 40 is configured to detachably connect any one of a plurality of different cleaning accessories 60, including, but not limited to, cleaning pads, sponges, brushes, abrasive pads, polishing cloths, etc., to the output shaft 24 of the rotary tool 1. The connector 40 includes a shallow, disc-shaped base 44 and a hollow stem 42 that protrudes from a tool-facing surface 46 of the base 44. Stiffening gussets 45 extend between the outer surface of the stem 42 and the tool-facing surface 46 of the base 44. An inner surface of the hollow stem 42 includes threads 43 that engage with the output shaft external thread 28, whereby the connector 40 is detachably connected to the output shaft 24 and rotates in concert with the output shaft 24. The base 44 includes a planar accessory-facing surface 48 that is opposed to the tool-facing surface 46. The accessory-facing surface 48 is configured to mechanically and detachably connect with a cleaning accessory 60. In the illustrated embodiment, the connection is made using a hook and loop fastener, and the accessory-facing surface 48 supports a layer of either hook or loop material. For example, in the illustrated embodiment, a layer of hook material 50 is secured to the accessory-facing surface 48.

Although the cleaning accessory 60 shown in the illustrated embodiment is a disc-shaped melamine foam pad 62 such as those known under the trademark "Scotch-Brite® easy erasing pad," the cleaning accessory 60 may be any one of many types of cleaning and/or polishing devices. As previously mentioned, the cleaning accessory 60 may be selected from the group that includes, but is not limited to, cleaning pads, sponges, brushes, abrasive pads, polishing cloths, and other cleaning or polishing devices. The pad 62 has a diameter that is larger than that of the connector base 44. A connector-facing surface 64 of the pad 62 supports a layer of either hook or loop material. For example, in the illustrated embodiment, the connector-facing surface 64 supports a layer of loop material 52, whereby the cleaning accessory can be detachably connected to the layer of hook material 50 provided on the connector 40. By this connection, the cleaning accessory rotates in concert with the output shaft 24.

The splash guard 80 is secured to the housing nose portion 14, and depends from the housing nose portion 14 in such a way as to surround the protruding portion of the output shaft 24, the connector 40 and the cleaning accessory 60. As a result, the splash guard 80 is configured to prevent liquid splash during use of the tool 1. The splash guard 80 includes a splash guard body 81, a rigid collar 82 disposed at a proximal end 88 of the splash guard body 81, and the rigid reinforcing ring 100 disposed at a distal end of the splash guard body 81.

The splash guard body 81 is a hollow, flexible member having a thin wall of non-uniform diameter. For example, the splash guard body 81 has the general shape of a truncated cone. The proximal end 88 of the splash guard body 81 is the end closest to the housing 2, and is dimensioned to surround the housing nose portion 14 with a tolerance fit. The distal end 90 of the splash guard body 81 is opposed to the proximal end 88, and a diameter of the distal end 90 is greater than the diameter of the proximal end 88. A longitudinal axis 86 of the splash guard body 81 extends between the proximal and distal ends 88, 90 and is co-axial with the rotational axis 26. The distal end 90 surrounds, and is radially spaced apart from, a periphery 66 of the cleaning accessory 60. Here, the term "radial" refers a direction with respect to the longitudinal axis 86. In the illustrated embodiment, the cleaning surface 68 of the cleaning accessory 60 is recessed relative to the splash guard distal end 90. However, in other embodiments, the cleaning surface 68 may be flush with the splash guard distal end 90.

The splash guard proximal end 88 is detachably connected to the housing nose portion 14 via the collar 82. The collar 82 is fixed to an inner surface of the splash guard proximal end 88. An inner surface of the collar 82 includes a pair of diametrically opposed bumps 84. Each bump 84 is a shallow, rounded protrusion that is received in a corresponding retaining groove 34 of the nose portion 14, and the bumps 84 cooperate with the grooves 34 to retain the splash guard 80 on the housing nose portion 14.

The splash guard body 81 is formed of a flexible plastic material. In particular, the splash guard body 81 is sufficiently flexible to deform radially inward when the splash guard 80 is pressed against an external object such as a wall. This flexibility allows the distance between the cleaning accessory periphery 66 and the splash guard 80 to be reduced, which in turn allows the cleaning accessory 60 to be positioned close to the external object (i.e., the wall) during cleaning. In addition, the splash guard body 81 is sufficiently flexible to deform longitudinally. To this end, the splash guard body 81 includes two annular regions 96(1), 96(2) that are spaced apart along, and centered on, the longitudinal axis 86. The first annular region 96(1) has a diameter that is greater than the diameter of the collar 82 and less than the diameter of the second annular region 96(2). The second annular region 96(2) includes the distal end 90. The annular regions 96(1), 96(2) are joined together via a longitudinally-tapering intervening region 98 that is disposed between the two annular regions 96(1), 96(2). The thickness of the splash guard body 81 is reduced at the intersections between the intervening region 98 and each of the first and second annular regions 96(1), 96(2), and these reduced-thickness portions 99 enable folding of the splash guard body 81 at the reduced-thickness portions 99. By this configuration, the splash guard body 81 is collapsible along the longitudinal axis 86 by folding the splash guard body 81 at the reduced-thickness portions 99 so that the first and second annular regions 96(1), 96(2) are concentric and radially aligned. When the splash guard 80 is in a collapsed configuration, the output shaft 24 is easily accessible and it becomes easy to exchange cleaning accessories 60.

The reinforcing ring 100 is an annular member that is disposed within the second annular region 96(2) so as to be located at the splash guard distal end 90. The reinforcing ring 100 is formed of material that less flexible than the plastic material used to form the splash guard body 81. For example, the splash guard 80 including the reinforcing ring 100 is still sufficiently flexible to allow for a shallow radial deflection of the distal end 90, but is sufficiently rigid to prevent interference of the splash guard 80 with the cleaning accessory 60 or the output shaft 24.

Figure 4:
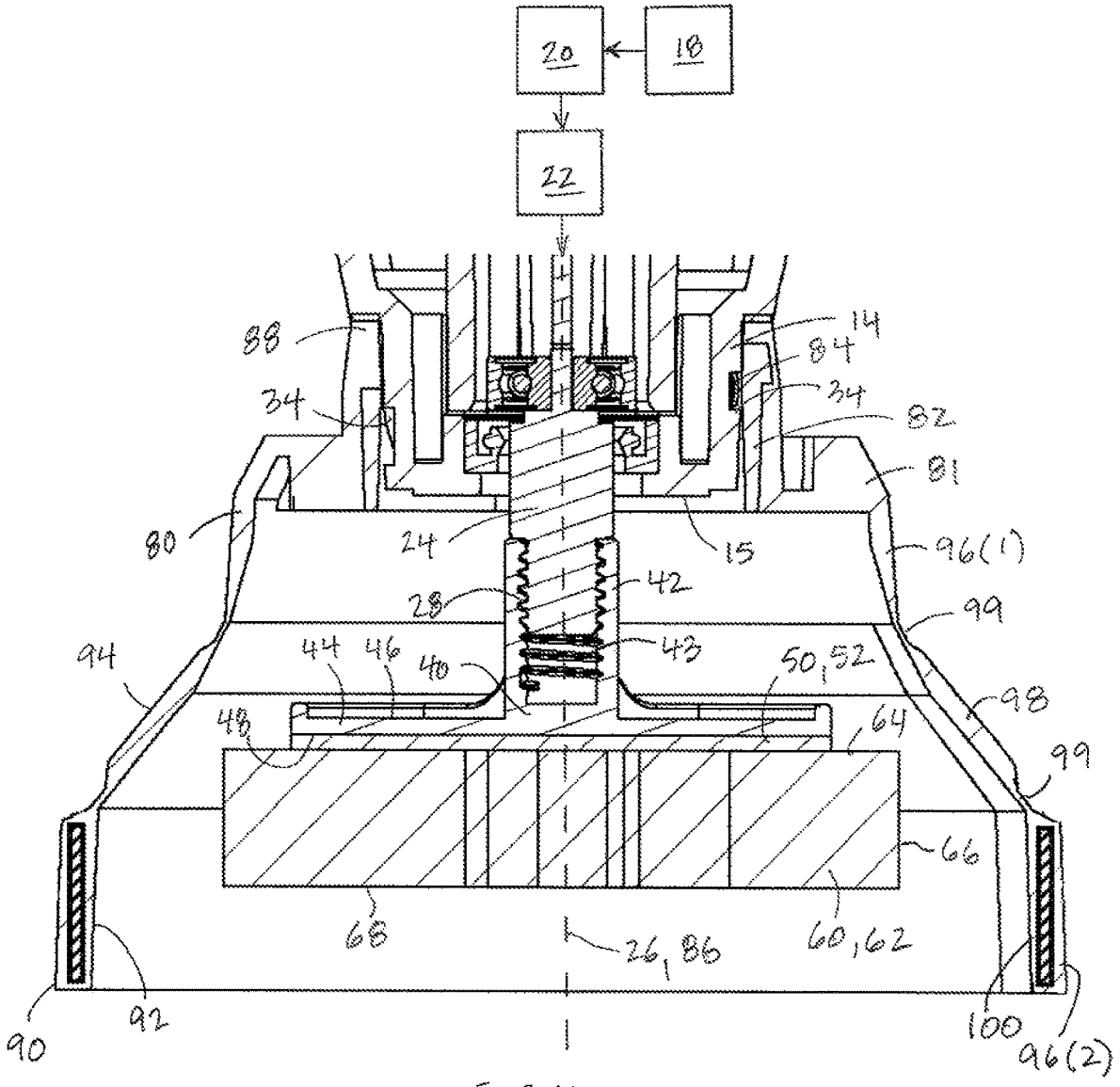
FIG. 4 is a cross-sectional view of a portion of the handheld rotary cleaning tool of FIG. 1 as seen along line 4-4 of FIG. 2, illustrating the reinforcing ring embedded in the distal end of the splashguard.

In the embodiment illustrated in FIG. 4, the reinforcing ring 100 is enclosed within the second annular region 96(2), which can be achieved, for example, in an insert molding manufacturing process.

Figure 5:
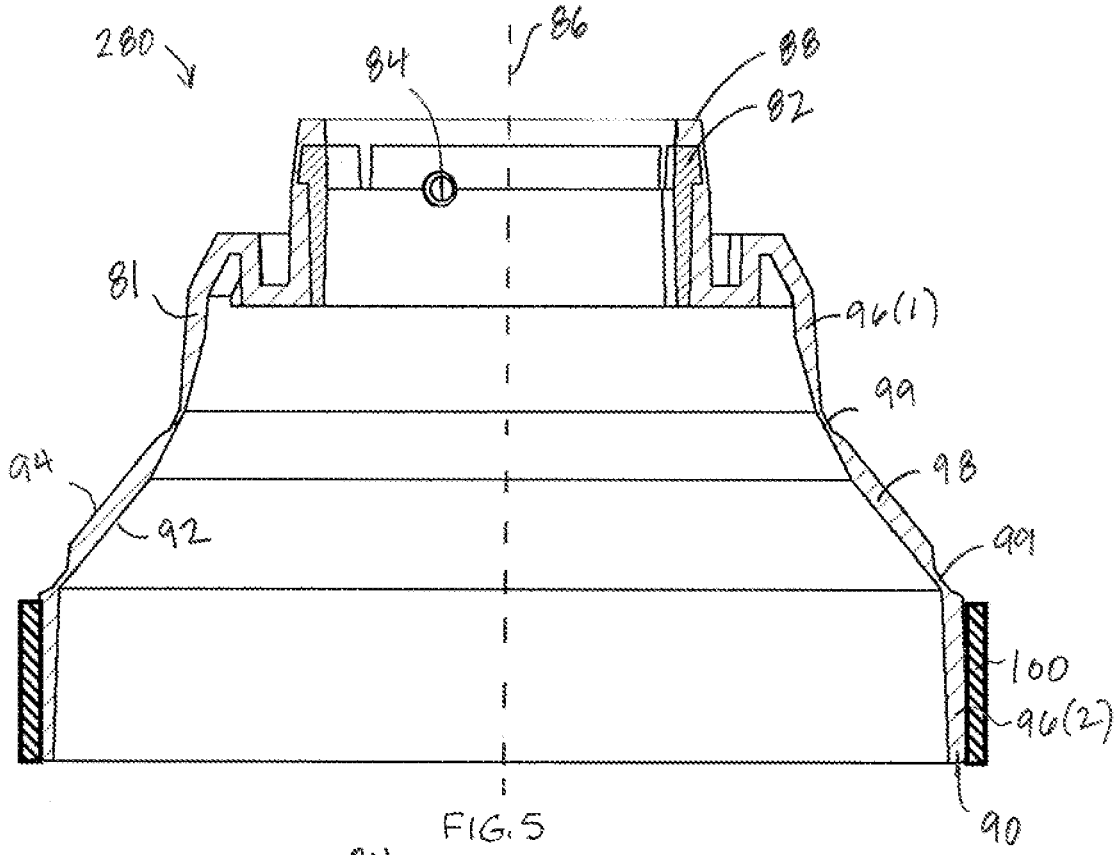
FIG. 5 is a cross-sectional view of an alternative embodiment splashguard, illustrating reinforcing ring provided on an outer surface of the splash guard.

Referring to FIG. 5, the rotary cleaning tool 1 may include an alternative embodiment splash guard 280. The splash guard 280 shown in FIG. 5 is substantially similar to the splash guard 80 described above with respect to FIGS. 1-4, and common reference numbers are used to refer to common elements. The splash guard 280 shown in FIG. 5 differs from the splash guard 80 described above with respect to FIGS. 1-4 in that the reinforcing ring 100 of the splash guard 280 is fixed to an outer surface 94 of the splash guard body 81, particularly to the outer surface of the second annular region 96(2) at the splash guard distal end 90. As in the previous embodiment, the reinforcing ring 100 serves to allow for a shallow radial deflection of the distal end 90, while preventing interference of the splash guard 80 with the cleaning accessory 60 or the output shaft 24.

Figure 6:
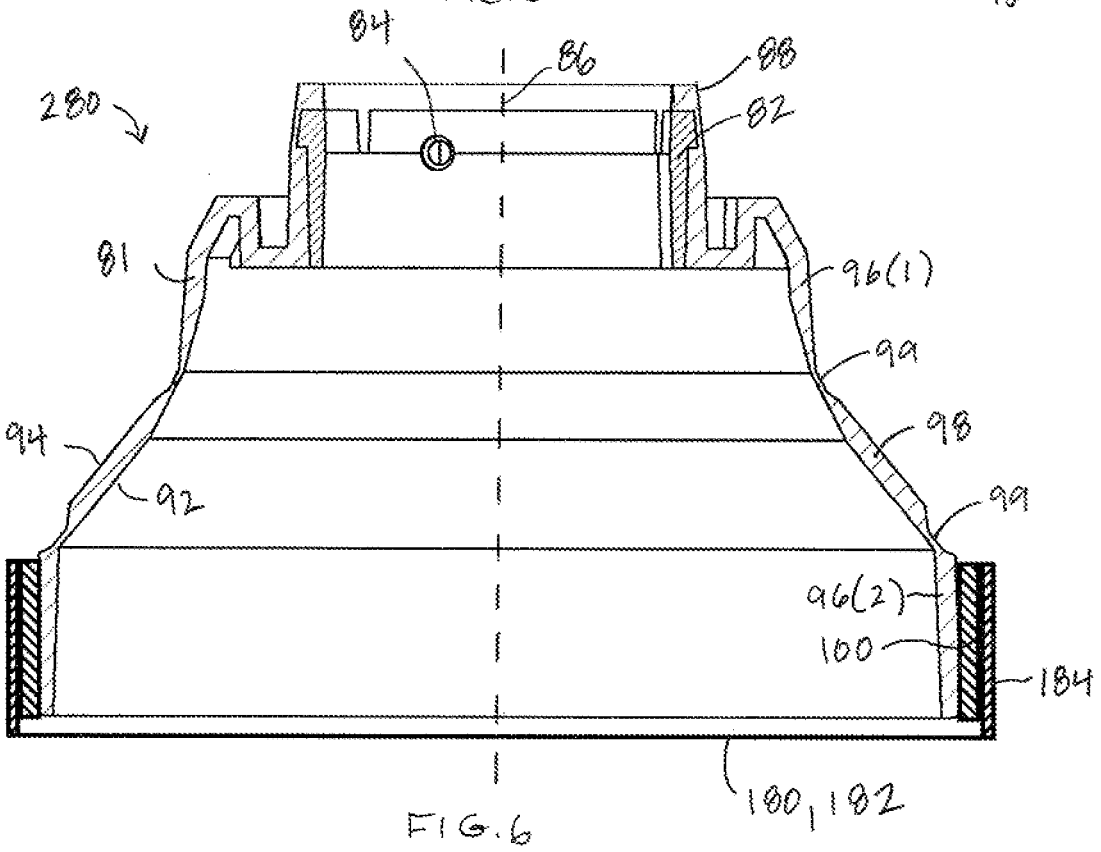
FIG. 6 is a cross-sectional view the splashguard of FIG. 5, illustrating a cap connected to the reinforcing ring.

Referring to FIG. 6, by providing the reinforcing ring 100 on the outer surface 94 of the splash guard distal end 90, the reinforcing ring 100 can be used as a connection interface. For example, in some embodiments, the reinforcing ring 100 may be used as a mechanical connection interface by which a cap 180 can be detachably secured to the distal end 90 of the splash guard body 81. In this example, the cap 180 is a shallow, cup-shaped structure including a closed end 182 that is surrounded by a sidewall 184. An inner diameter of the sidewall 184 is dimensioned to provide a press-fit connection with the outer surface of the reinforcing ring 100, whereby the cap 180 can be press fit onto the splash guard 280. Advantageously, the cap 180 can be used to close the distal end 90 of the splash guard 280. As a result, the cap 180 can be used to keep the cleaning accessory 60 clean before use, and/or can be used to seal the interior space of the splash guard 280 following use so that the wet and/or soiled cleaning accessory 60 is contained and drips from any residual cleaning solution are avoided.

Figure 7:
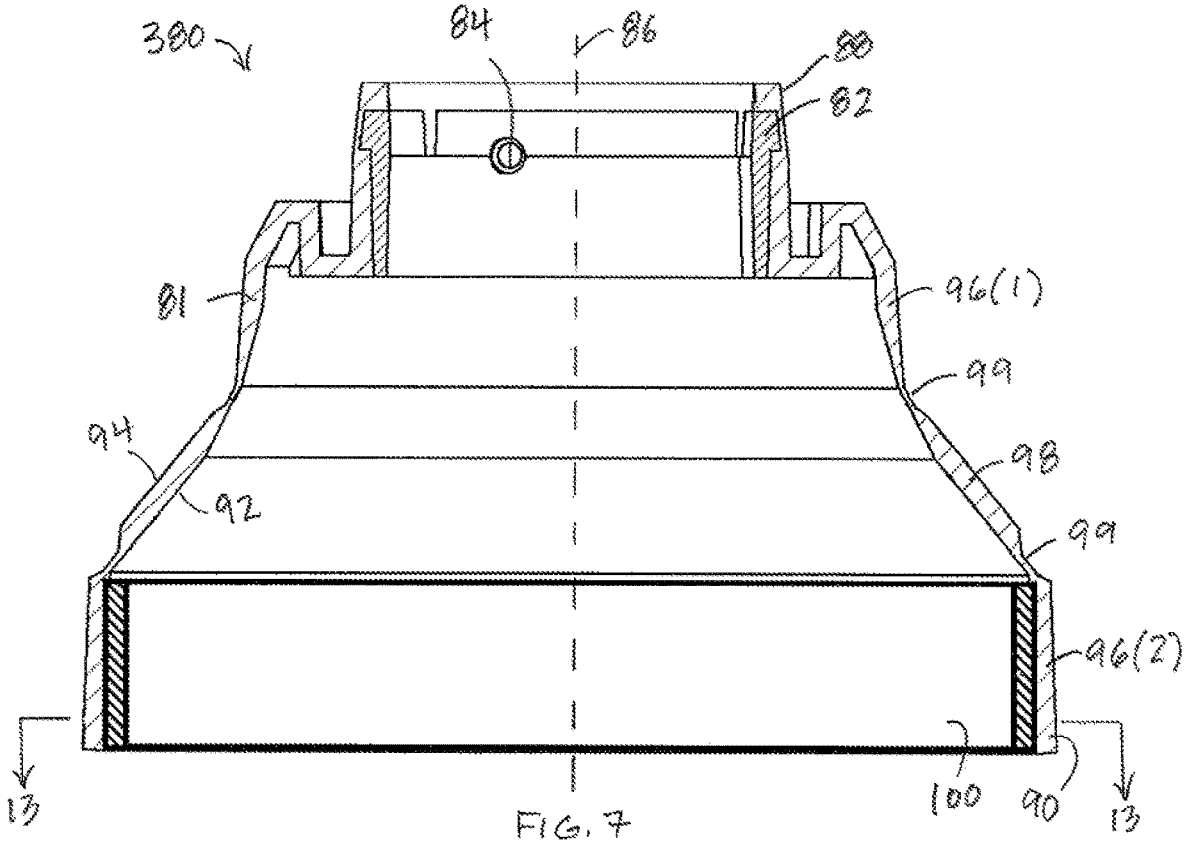
FIG. 7 is a cross-sectional view of another alternative embodiment splashguard, illustrating the reinforcing ring provided on an inner surface of the splash guard.

Referring to FIG. 7, the rotary cleaning tool 1 may include another alternative embodiment splash guard 380. The splash guard 380 shown in FIG. 7 is substantially similar to the splash guards 80, 280 described above with respect to FIGS. 1-5, and common reference numbers are used to refer to common elements. The splash guard 380 shown in FIG. 7 differs from the splash guards 80, 280 described above with respect to FIGS. 1-5 in that the reinforcing ring 100 of the splash guard 380 is fixed to an inner surface 92 of the splash guard body 81, particularly to the inner surface of the second annular region 96(2) at the splash guard distal end 90. As in the previous embodiment, the reinforcing ring 100 serves to allow for a shallow radial deflection of the distal end 90, while preventing interference of the splash guard 80 with the cleaning accessory 60 or the output shaft 24.

Figure 8:
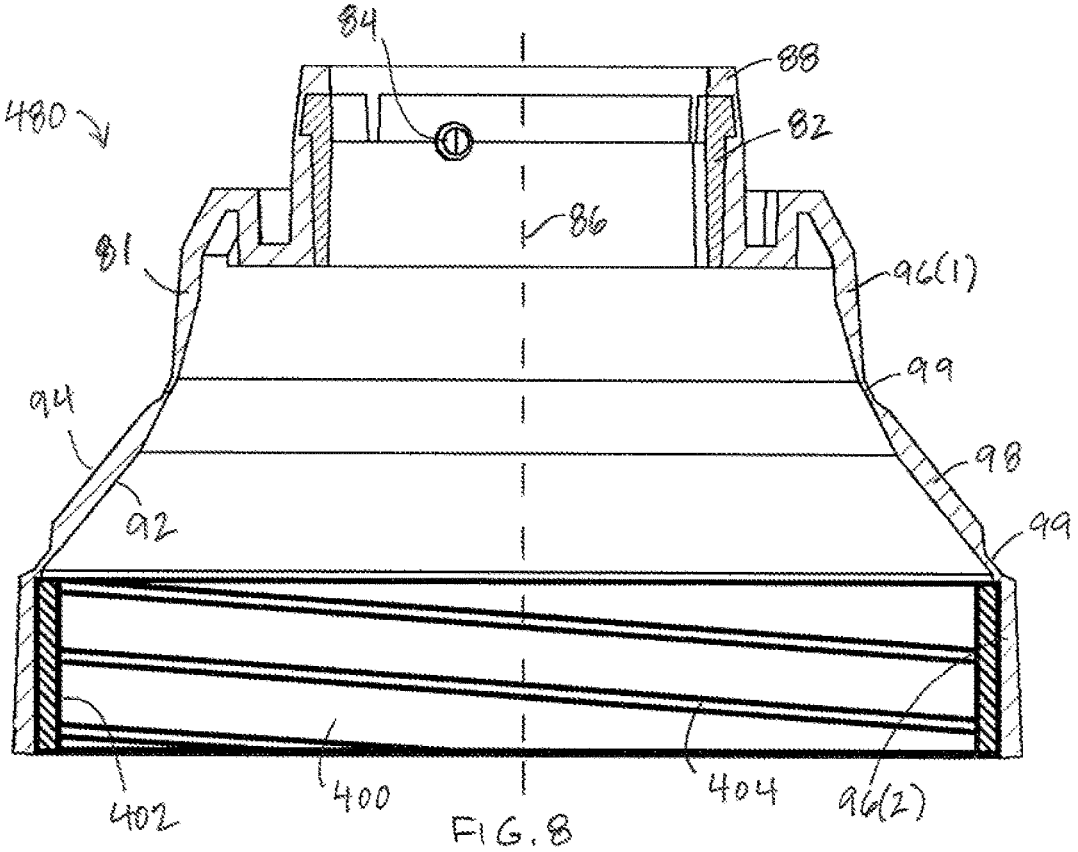
FIG. 8 is a cross-sectional view of another alternative embodiment splashguard, illustrating the reinforcing ring provided on an inner surface of the splash guard and including surface features that allow for a threaded mechanical connection to a splash guard accessory.

Referring to FIG. 8, the rotary cleaning tool 1 may include another alternative embodiment splash guard 480. The splash guard 480 shown in FIG. 8 is substantially similar to the splash guard 380 described above with respect to FIG. 7, and common reference numbers are used to refer to common elements. The splash guard 480 shown in FIG. 8 differs from the splash guard 380 described above with respect to FIG. 7 in that it includes an alternative embodiment reinforcing ring 400. The reinforcing ring 400 is similar to the reinforcing ring 100 of FIG. 7, except that an inner surface 402 of the reinforcing ring 400 includes surface features that provide a mechanical connection interface by which a splash guard accessory 160 can be detachably secured to the distal end 90 of the splash guard body 81. Examples of splash guard accessories 160 may include, but are not limited to, a ring of bristles (not shown), an annular sponge (see FIG. 10), an annular arrangement of squeegee elements (not shown), etc. In the illustrated embodiment, the mechanical connection interface includes an internal helical thread 404 formed on the reinforcing ring inner surface 402. A splash guard accessory 160 to be connected to the reinforcing ring 400 would include a corresponding mating external helical thread, whereby the splash guard accessory 160 can be detachably connected to the splash guard 480.

Figure 9:
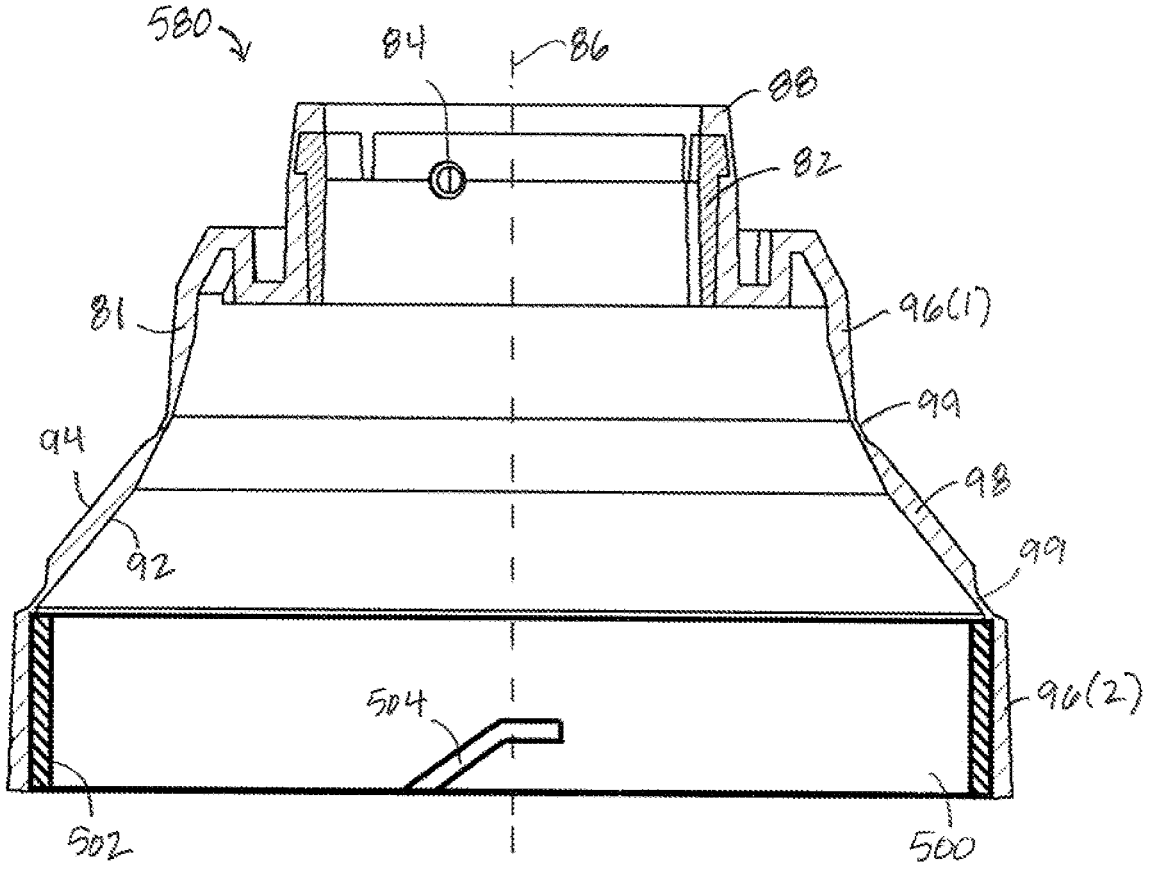
FIG. 9 is a cross-sectional view of another alternative embodiment splashguard, illustrating the reinforcing ring provided on an inner surface of the splash guard and including surface features that allow for a bayonet mechanical connection to a splash guard accessory.
Figure 10:
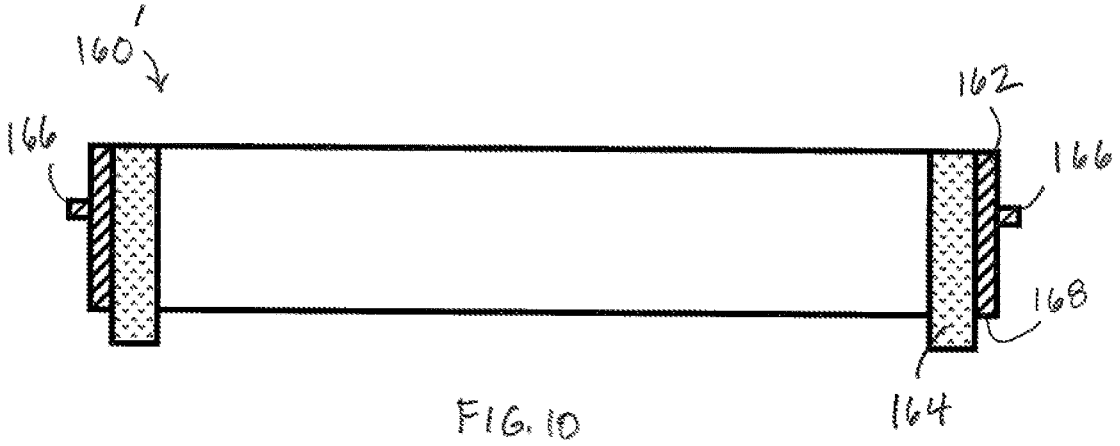
FIG. 10 is a cross-sectional view of a splash guard accessory including surface features that allow for connection to the reinforcing ring of FIG. 9.

Referring to FIGS. 9 and 10, the rotary cleaning tool 1 may include another alternative embodiment splash guard 580. The splash guard 580 shown in FIG. 9 is substantially similar to the splash guard 480 described above with respect to FIG. 8, and common reference numbers are used to refer to common elements. The splash guard 580 shown in FIG. 9 differs from the splash guard 480 described above with respect to FIG. 8 in that it includes an alternative embodiment reinforcing ring 500. The reinforcing ring 500 is similar to the reinforcing ring 400 of FIG. 8, except that the inner surface 502 of the reinforcing ring 500 includes a different mechanical connection interface than that provided in the previous embodiment. In particular, the inner surface 502 of the reinforcing ring 500 includes a pair of diametrically opposed grooves 504 that provide the groove portion of a bayonet connection interface.

A splash guard accessory 160' (FIG. 10) that is configured to be connected to the reinforcing ring 500 includes an annular ring 162, and an annular sponge 164 that is fixed to an inner surface of the annular ring 162 and protrudes beyond a distal end 168 of the annular ring 162. The outer surface of the annular ring 162 is dimensioned to be received within the reinforcing ring 500 with a tolerance fit. In addition, the outer surface of the annular ring 162 includes a mechanical connection interface for detachably connecting to the reinforcing ring 500. In particular, the outer surface of the annular ring 162 includes a corresponding pair of mating external protrusions 166 that are configured to be received, and retained, in the grooves 504, whereby the splash guard accessory 160' can be detachably connected to the splash guard 580 via a bayonet connection.

Figure 11:
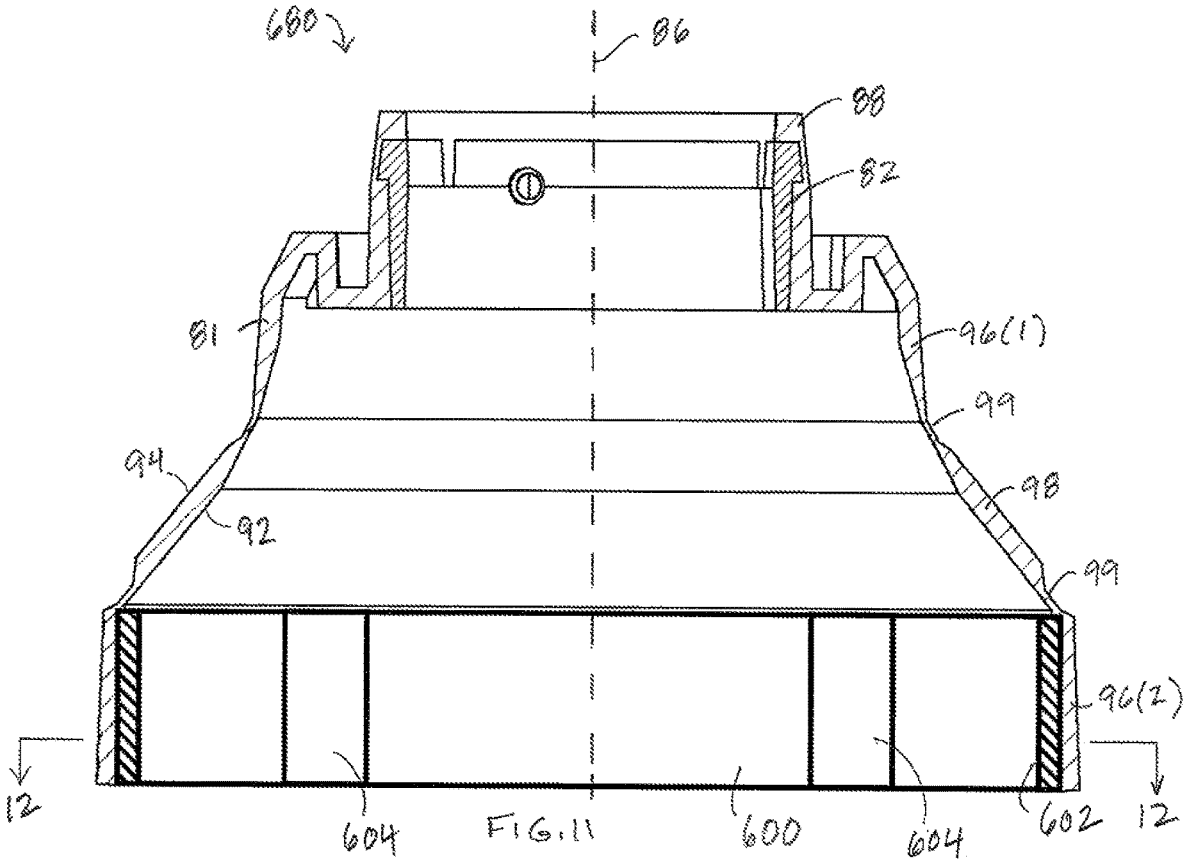
FIG. 11 is a cross-sectional view of another alternative embodiment splashguard, illustrating the reinforcing ring provided on an inner surface of the splash guard and including surface features that allow for fluid direction and circulation within the splashguard.
Figure 12:
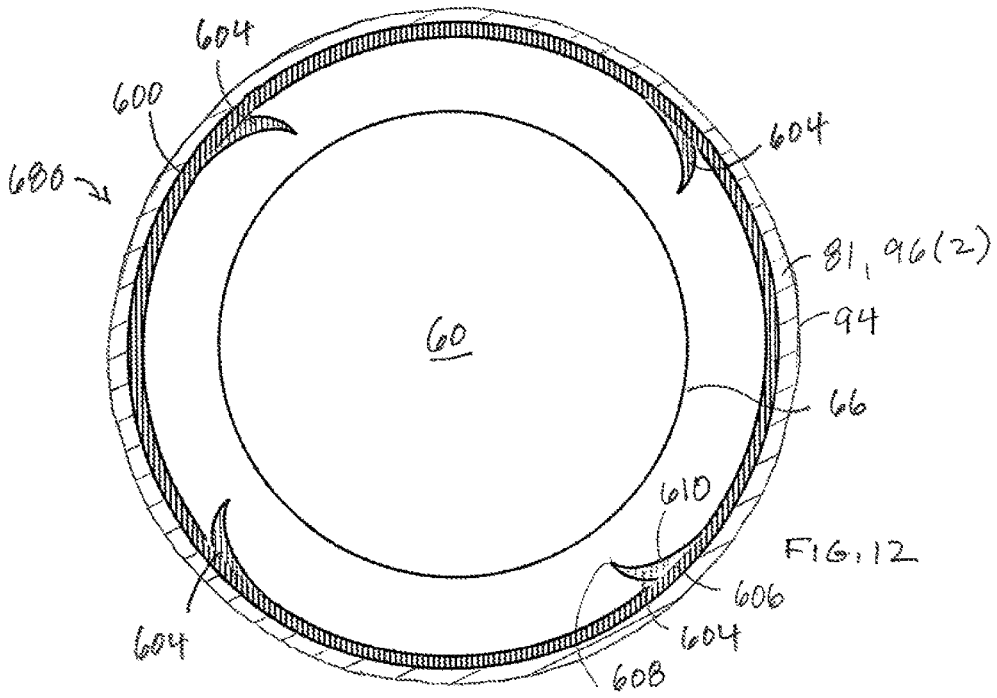
FIG. 12 is a cross-sectional view of the splash guard of FIG. 11 as seen along line 12-12, shown surrounding a cleaning accessory.

Referring to FIGS. 11 and 12, the rotary cleaning tool 1 may include another alternative embodiment splash guard 680. The splash guard 680 shown in FIG. 11 is substantially similar to the splash guard 380 described above with respect to FIG. 7, and common reference numbers are used to refer to common elements. The splash guard 680 shown in FIG. 11 differs from the splash guard 380 described above with respect to FIG. 7 in that it includes another alternative embodiment reinforcing ring 600. The reinforcing ring 600 is similar to the reinforcing ring 100 of FIG. 7, except that an inner surface 602 of the reinforcing ring 600 includes surface features that direct the flow of fluid within the splash guard 680. For example, in the illustrated embodiment, the reinforcing ring 600 includes fins 604 that protrude radially inward toward the longitudinal axis 86 from the reinforcing ring inner surface 602 (e.g., from an output shaft-facing surface of the ring 600). Each fin 604 has a wide base 606 that is integral with the reinforcing ring inner surface 602, and tapers to an apex 608. Each fin 604 has a longitudinal dimension that corresponds to the longitudinal dimension of the ring 600. Each fin 604 is at an acute angle relative to the reinforcing ring inner surface 602. In the illustrated embodiment, the cleaning accessory-facing surface 610 of each fin 604 is curved so that the apex 608 generally points toward the longitudinal axis 86. As a result, the fins 604 are configured to direct fluid within the splash guard 680 toward the cleaning accessory 60. In some embodiments, the fins 604 may be rigid, while in other embodiments the fins 604 may be flexible and elastic. In the illustrated embodiment, the reinforcing ring 600 includes four fins 604, but the reinforcing ring 600 may include a greater or fewer number of fins 604 as determined by the requirements of the application. The fins 604 may be equidistantly spaced apart, from each other along a circumference of the reinforcing ring inner surface 602.

Figure 13:
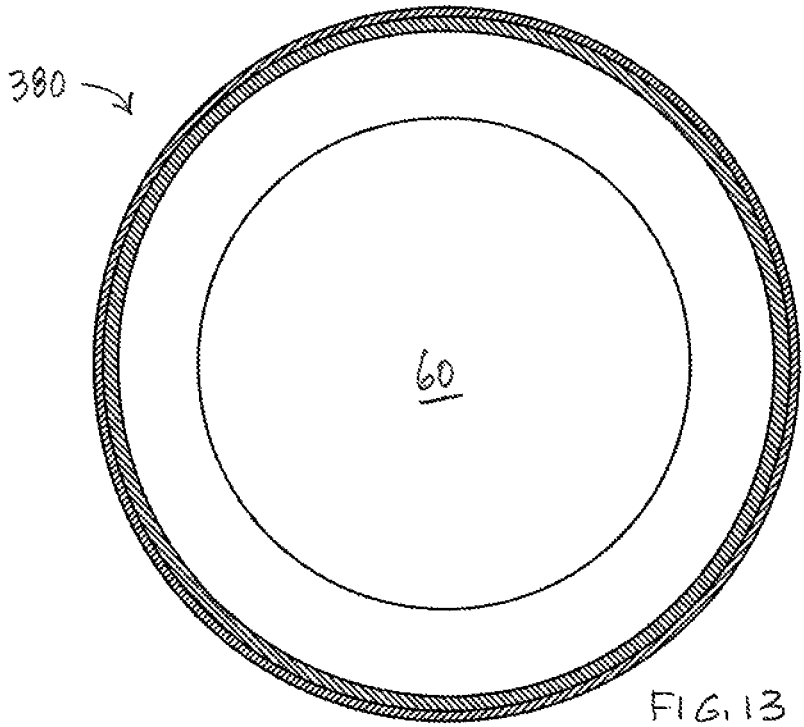
FIG. 13 is a cross-sectional view of the splash guard of FIG. 7 as seen along line 13-13 of FIG. 7, shown surrounding a cleaning accessory.
Figure 14:
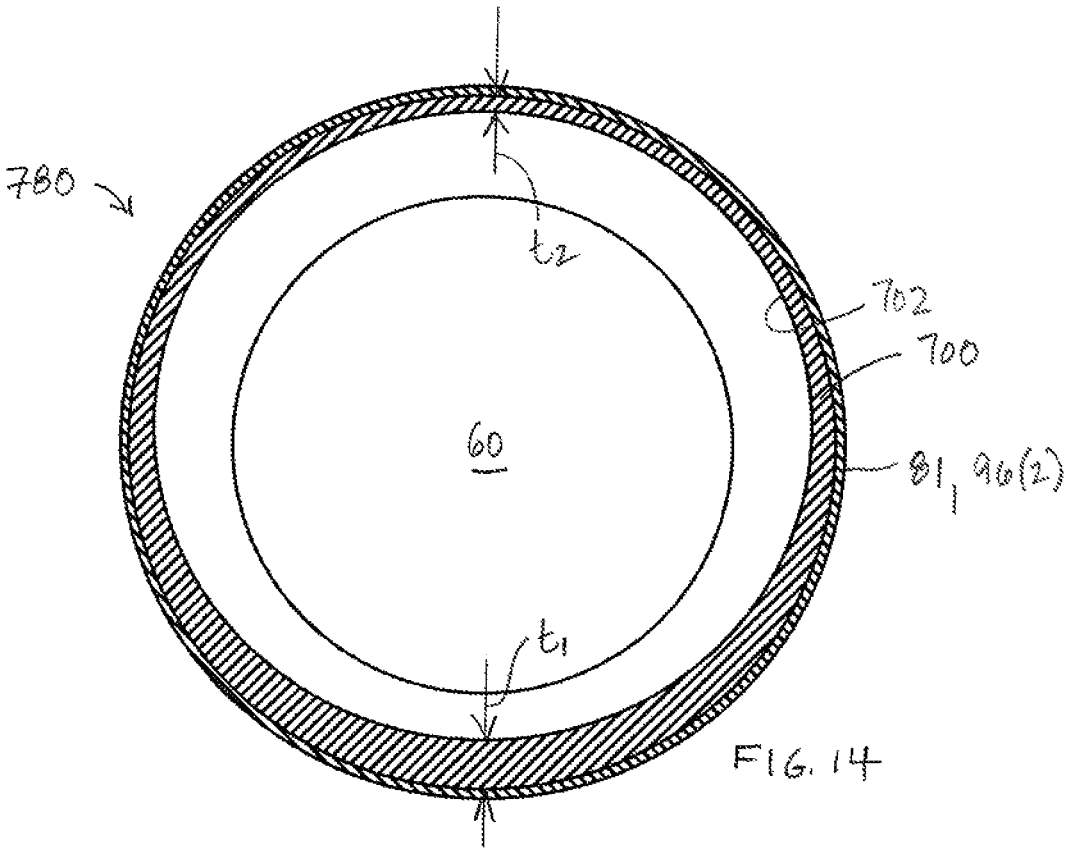
FIG. 14 is a cross-sectional view of another alternative embodiment splashguard, shown surrounding a cleaning accessory and illustrating an eccentric shape that allows for fluid circulation within the splashguard.

Referring to FIGS. 13 and 14, the rotary cleaning tool 1 may include another alternative embodiment splash guard 780 (FIG. 14). The splash guard 780 shown in FIG. 14 is substantially similar to the splash guard 380 described above with respect to FIG. 7, and Common reference numbers are used to refer to common elements. Note that the splash guard 380 of FIG. 7 is shown in bottom view in FIG. 13). The splash guard 780 shown in FIG. 14 differs from the splash guard 380 described above with respect to FIG. 7 in that it includes another alternative embodiment reinforcing ring 700. The reinforcing ring 700 is similar to the reinforcing ring 100 of FIG. 7, except that an inner surface 702 of the reinforcing ring 700 includes surface features that direct the flow of fluid within the splash guard 680. In this example, the inner surface 702 of the reinforcing ring 700 is shaped to cooperate with the cleaning accessory 60 to redistribute fluid within the splash guard 780. In particular, the reinforcing ring 700 is joined to the inner surface 92 of the splash guard 780 at the distal end 90 of the splash guard 780, and a distance of the ring inner surface 702 from the longitudinal axis 86 varies along a circumference of the ring 700. This is achieved by providing the ring 700 with a non-uniform thickness, where the thickness of the ring 700 corresponds to a dimension of the ring 700 in a direction perpendicular to the longitudinal axis 86 (e.g., the radial dimension). In the illustrated embodiment, the ring thickness t1 at one side of the ring 700 is greater than the ring thickness t2 at an opposed side of the ring 700. As a result, the reinforcing ring 700 has an outer diameter that is concentric with the rotational and longitudinal axes 26, 86 and an inner diameter that is eccentric with respect to the rotational and longitudinal axes 26, 86. In addition, the ring inner surface 702 is closer to the cleaning accessory 60 at the one side of the ring 700 than at the opposed side of the ring 700. This can be beneficial when the cleaning tool 1 is used to clean a vertical surface and fluid is trapped within the splash guard 780. By orienting the tool 1 so that the one side of the ring 700 is at the lowest point, fluid within the splash guard 780 collects adjacent the one side of the ring 700. The fluid collected at the lowest point is easily taken up the cleaning accessory 60 and redistributed.

Although the rotary cleaning tool 1 described above includes a rechargeable battery 18, the tool 1 is not limited to this type of power supply. For example, in some embodiments, the battery 18 is not rechargeable. In other embodiments, the battery 18 is omitted, and the motor 20 is powered by a wired connection to a utility power line.

Although the connector 40 described above forms a detachable mechanical connection with the cleaning accessory 50 via hook and loop fastener, the connector 40 is not limited to this, type of connection to the cleaning accessory 60, and any suitable connection may be substituted for the hook and loop fastener. Other suitable connection methods may include magnets, adhesive, snap fasteners, etc.

Selective illustrative embodiments of the rotary cleaning tool and splash guard are, described above in some detail. It should be understood that only structures considered necessary for clarifying the rotary cleaning tool and splash guard have been described herein. Other conventional structures, and those of ancillary and auxiliary components of the rotary cleaning tool and splash guard, are assumed to be known and understood by those skilled in the art. Moreover, while a working example of the rotary cleaning tool and splash guard have been described above, the rotary cleaning tool and splash guard are not limited to the working examples described above, but various design alterations may be carried out without departing from the rotary cleaning tool and splash guard as set forth in the claims.

We claim:

1. A hand-held rotary scrubbing tool, comprising:

a housing having a shape that is configured to be held, and a size that is adapted for lifting, manipulation and operation of the tool;

a motor disposed in the housing, the motor including an output shaft that protrudes out of the housing, the output shaft being configured to be connected to a first accessory in such a way that the first accessory is driven by the motor to rotate relative to the housing about a rotational axis;

a splash guard that surrounds the output shaft, the splash guard having a proximal end that is connected to the housing, a distal end that is opposed to the proximal end, and a tubular shape of non-uniform diameter, the proximal end having a smaller diameter than the distal end, the splash guard being formed of a first material having a first flexibility;

a reinforcing ring disposed at the distal end, the reinforcing ring being formed of a second material having a second flexibility, and the second flexibility is less than the first flexibility.

2. The tool of claim 1, wherein the reinforcing ring is enclosed within the splash guard at the distal end of the splash guard.

3. The tool of claim 1, wherein the reinforcing ring is joined to the outer surface of the splash guard at the distal end of the splash guard.

4. The tool of claim 1, wherein the reinforcing ring is joined to the inner surface of the splash guard at the distal end of the splash guard.

5. The tool of claim 1, wherein the reinforcing ring is joined to the inner surface of the splash guard at the distal end of the splash guard, and an output shaft-facing surface of the ring includes ring surface features that are configured to engage, and form a mechanical connection with, corresponding accessory surface features of a second accessory.

6. The tool of claim 5, wherein the ring surface features include a helical thread.

7. The tool of claim 5, wherein the ring surface features are configured to provide a bayonet connection.

8. The tool of claim 1, wherein the reinforcing ring is joined to the inner surface of the splash guard at the distal end of the splash guard, and an output shaft-facing surface of the ring includes ring surface features that direct the flow of fluid within the splash guard.

9. The tool of claim 8, wherein the ring surface features include a fin that protrudes from the output shaft-facing surface, and the fin is at an acute angle relative to the output shaft-facing surface.

10. The tool of claim 8, wherein the fin is flexible.

11. The tool of claim 8, wherein the fin includes several fins, and the fins are spaced apart from each other along a circumference of the shaft-facing surface.

12. The tool of claim 8, wherein the surface features are configured to direct fluid within the splash guard toward the output shaft.

13. The tool of claim 1, wherein the reinforcing ring is joined to the inner surface of the splash guard at the distal end of the splash guard, and the ring has a non-uniform thickness, where the thickness of the ring corresponds to a dimension of the ring in a direction perpendicular to the rotational axis.

14. The tool of claim 1, wherein the reinforcing ring is joined to the inner surface of the splash guard at the distal end of the splash guard, the ring has an inner surface, and a distance of the ring inner surface from the rotational axis varies along a circumference of the ring.

15. The tool of claim 1, wherein the reinforcing ring has an outer diameter that is concentric with the rotational axis and an inner diameter that is eccentric with respect to the rotational axis.

16. The tool of claim 1, wherein the splash guard includes at least two annular regions that are spaced apart along a longitudinal axis of the splash guard, the annular regions are more rigid than a foldable intervening region that is disposed between and is joined to the two annular regions, whereby the splash guard is collapsible along the longitudinal axis, and the reinforcing ring is supported on one of the annular regions, the one of the annular regions being the annular region that is furthest from the proximal end.

17. The tool of claim 1, wherein the first accessory is connected to the output shaft via a connector, and the connector comprises a hollow stem that is shaped and dimensioned to receive and engage the output shaft, and a base that is disposed at one end of the stem, the base configured to be detachably connected to the first accessory.

* * * * *